United States Patent [19]

Helinski

[11] Patent Number: 4,721,635

[45] Date of Patent: Jan. 26, 1988

[54] COLOR PRINTED RECORD AND METHOD

[75] Inventor: Richard R. Helinski, Hudson, N.H.

[73] Assignee: Howtek, Inc., Hudson, N.H.

[21] Appl. No.: 942,615

[22] Filed: Dec. 17, 1986

Related U.S. Application Data

[63] Continuation-in-part of Ser. No. 796,223, Nov. 8, 1985, Pat. No. 4,666,757.

[51] Int. Cl.[4] ..... B41M 5/00

[52] U.S. Cl. ..... 428/15; 156/277; 346/135.1; 427/256; 427/265; 428/203; 428/204; 428/207; 428/913

[58] Field of Search ..... 428/187, 195, 203, 204, 428/207, 211, 484, 488.1, 488.4, 914, 15, 913; 156/277; 346/135.1; 427/256, 258, 261

[56] References Cited

U.S. PATENT DOCUMENTS 4,390,369 6/1983 Merritt et al. ..... 106/20

4,666,757 5/1987 Helinski ..... 428/203

FOREIGN PATENT DOCUMENTS 2430318 3/1980 France ..... 428/914

115211 9/1981 Japan ..... 428/914

51181 3/1983 Japan ..... 428/914

*Primary Examiner*—John E. Kittle

*Assistant Examiner*—P. R. Schwartz

*Attorney, Agent, or Firm*—Cesari and McKenna

[57] ABSTRACT

A printed record in color comprises a transparent sheet on which is jet-printed subtractive color inks in layers of different color. The inked surface of the transparent sheet is adhered to the surface of an opaque backing sheet, usually white in color, so that the backing sheet reflects ambient light back through the ink layers and the transparent sheet so as to provide a color image visable through the transparent sheet that is characterized by high color density and brightness.

5 Claims, 3 Drawing Figures

COLOR PRINTED RECORD AND METHOD

This application is a continuation-in-part of application Ser. No. 796,223, filed Nov. 8, 1985, entitled COLOR PRINTED RECORD, now U.S. Pat. No. 4,666,757.

This invention relates to color printing. It relates more particularly to an improved color printed record and a method of making that record.

BACKGROUND OF THE INVENTION

Inks that are utilized to print documents in color using a dot matrix format are subject to several demanding and often conflicting limitations. The ink must adhere to the medium without soaking into the medium and bleeding excessively lest the sharpness or resolution of the recorded image be reduced to an unacceptable level. As an example of the degree of sharpness required, current commerical applications require a resolution in the order of 240×400 (i.e., 240 dots per inch in the horizontal direction and 400 dots per inch in the vertical direction) for text printing. High quality graphic printing requires resolutions from 600 to 1000 dots or resolution elements per inch in each direction. Ink must also be resistance to abrasion as well as to smudging or inadvertant transfer or offsetting to adjacent materials. Additionally, since a particular printed document may pass through a variety of climates and office environments, the ink must remain stable at temperatures ranging from −20° C. to +150° C.

The restrictions are quite severe when applied to black ink, but are even more stringent when applied to color inks because even minor changes in color and hue are noticible to the human eye. In the case of inks that are to be applied by ink jet printing techniques, the problem is further compounded by the requirement that the inks be compatible with the jetting requirements of the printer. Typically this application imposes tight constraints on the characteristics of the ink so that the ink can be expelled properly from the jet nozzle as relatively uniform droplets without escessive satelliting. Thus the physical properties of the ink such as viscosity and surface tension must be within certain ranges if the ink is to be jetted properly. Also, the ink must not clog the nozzle orifice and it must produce images of sufficient optical density to create a good quality printed record. Additionally, the ink must have a high rate of fixing to the recording medium and not wrinkle, curl or otherwise adversely affect the medium.

Satisfactory color printing by ink jet involves, then, the formation on the recording medium of a multiplicity of colored dots or spots of different color intensities, depending upon the color requirements of the various parts of the character or picture being printed on the medium. This wide color spectrum can be obtained by using three or four different color inks, either by an additive color mixing process or by a substractive mixing process. In the former, red, green, blue and sometimes black ink drops are deposited on the medium side by side in a dot matrix. The different color dots are integrated in the observer's eye so that he perceives colors dependent upon the relevant numbers and/or sizes of the different color dots at each part of the printed character or picture.

In the subtractive process, the printer deposits ink drops of the primary substractive colors, namely cyan, magenta and yellow, and perhaps also black, on the medium in superposition in a dot matrix arrangement so that each dot is composed of one or more layers, up to three or four, of printing inks having different color intensities depending upon the color requirements of the particular portion of the character or picture being printed. Each dot layer absorbs a portion of the spectrum of the ambient light illuminating the medium so that the viewer's eye senses the remainder of the light spectrum. Thus, when several ink layers, each of a different primary color, are present in a single dot in the matrix, several spectral portions are absorbed simultaneously so that a smaller part of the spectrum of incident light is reflected causing the viewer's eye to sense a mixed color produced by the subractive mixture of the primary colors. Thus, true color printing using the subtractive color mixing process depends upon the precision of the printing process as well as the optical properties of the different color printing inks. The color graphics industry prefers to print by subtractive color mixing because the resultant color print is brighter and more vivid than that resulting from additive color mixing, particularly when the power of the ambient light is relatively low.

Known commercial printing inks can be divided into three different types, namely water-base inks, oil-base inks and hot-melt or plastic-base inks. Presently, only the first two ink types are used in commercial jet printers. However, the quality of the printed copy produced by those inks is not as high as might be desired. The resultant interaction of the water or oil in the ink and the recording medium distorts the medium; it also results in the incident light being reflected diffusely from the color dots or resolution elements on the medium so that the observed printed colors are muted. Further, those inks have low surface tensions so that when deposited on the recording medium, they tend to form dots which are fairly irregular in shape. In short, color printing by ink jet has not gained wide acceptance because the quality of the color copy is not even good enough to meet the standards of the printing industry, much less of the color graphics industry.

Very recently, an ink jet printer has been developed which is able to print on a conventional recording medium such as ordinary paper using special hot-melt subtractive color inks. This printer and the inks used therein are disclosed in U.S. patent applications Ser. Nos. 688,000, filed Dec. 31, 1984; 748,768, filed June 25, 1985 and 749,861, filed June 24, 1985. All of these pending applications are owned by the assignee of the present application and their disclosures are incorporated by reference wherein. Using the printer and inks described therein, one can produce by ink jet printing, color text and graphics which are superior in quality to the color copy made using conventional jet printers and inks. However, the resulting color print is still not bright and vivid enough to entirely satisfy the stringent requirements of the color graphics industry. In other words, the color records produced by the new ink jet printer and inks still do not match the quality of the records made using conventional offset printing techiniques in terms of color brightness and optical clarity. Moreover, the quality of all these prior printed records deteriorates oven time due to the effects of moisture, oxidation and exposure to ultraviolet light from the sun and some fluorescent lights. Therefore, it would be desirable to improve the color printing resulting from the use and application of jet printers and inks, particularly the ones disclosed in said pending applications, so that the quality of color records produced by them compare favorably to the color records produced using known offset printing and photographic techniques.

SUMMARY OF THE INVENTION

Accordingly, an object of the present invention is to provide an improved color printed record.

Another object of the invention is to provide a permanent record composed of very bright and vivid color print.

Still another object of the invention is to provide a color record printed by an ink jet whose color quality compares favorably with that of the color record produced by standard offset printing process and even by digital photographic techniques.

Yet another object is to provide an ink jet color printed record which is more durable than standard paper records.

A further object of the invention is to provide a color printed record whose printing cannot be smudged or abraded.

Still another object of the invention is to provide such a printed record which is substantially unaffected by moisture or changes in humidity.

Still another object of the invention is to provide a color printed record which is substantially unaffected by ultraviolet light.

Another object of the invention is to provide a photograph-like printed record which is less expensive to make, by an order of magnitude, than a conventional digital photograph or offset printed picture of comparable quality.

A further object of the invention is to provide a method of making a flat-surface, dot matrix, color image that has very high optical density and brightness.

Another object is to provide a method of making a color printed record having one or more of the above characteristics.

Other objects will, in part, be obvious and will, in part, appear hereafter.

The invention accordingly comprises the several steps and the relation of one or more of such steps with respect to each of the others, and the article possessing the features, properties and relation of elements which are exemplified in the following detailed disclosure, and the scope of the invention will be indicated in the claims.

In accordance with the present invention, printed records composed of lines, characters and even pictures of superior quality are printed in color, preferably by means of an ink jet printer. To make these color printed records, subtractive color inks are jetted onto one surface of a flexible transparent sheet so as to make a reverse copy of the original document or picture. For best results, the inks are hot-melt inks of high optical density and clarity and which have surface tensions and viscosities such that when individual ink droplets strike the transparent sheet, they adhere tenaciously to the sheet. Furthermore, the adherent surface of ink droplet conforms to the sheet's surface and flattens to form a color dot having a planar interface or boundary between the color dot and the sheet surface. If the printing relies on subtractive color mixing, one or more different color ink dots are superimposed on the first dot forming a layered structure with the boundaries between adjacent ink layers being well defined and more or less parallel to the sheet surface. The ink dots are arranged in a matrix format so that together they define on the plastic sheet, a color copy in reverse of the original document or picture.

Next, the printed surface of the transparent sheet is affixed to a coextensive, flexible opaque backing sheet which is reflective to the ambient light. In the usual case, where the light is ordinary white light, the backing sheet may be a sheet of ordinary white paper, When viewed through the plastic sheet, the resultant color copy, whose orientation now corresponds to that of the original document or image, is extremely bright and vivid and, indeed, its quality is comparable to the color quality of records produced by conventional offset color printing and digital photography techniques.

The color printing on the record made as aforesaid is incapsulated between the plastic sheet and the backing sheet. Therefore, it is substantially immune to smudging, abrasion and oxidation which normally affect the condition and quality of color print over time. Furthermore, if the transparent sheet is made of a plastic which absorbs ultraviolet light, the color print will not fade even after prolonged exposure to sunlight.

Yet, with all of these advantages, the printed record or copy is much less expensive to make then prints and pictures of comparable quality made by ordinary digital photography and offset printing processes. Therefore, my technique for making high quality color prints and copies should find wide application particularly in connection with home and business computer and electronic photography systems where the user often has need to print out in volume computer or electronic photography-generated data as high quality color graphics and pictures.

BRIEF DESCRIPTION OF THE DRAWING

For a fuller understanding of the invention, reference should be made to the following detailed description, taken in connection with the accompanying drawing, in which.

DETAILED DESCRIPTION OF THE PREFERRED EMBODIMENT

Figure 1:
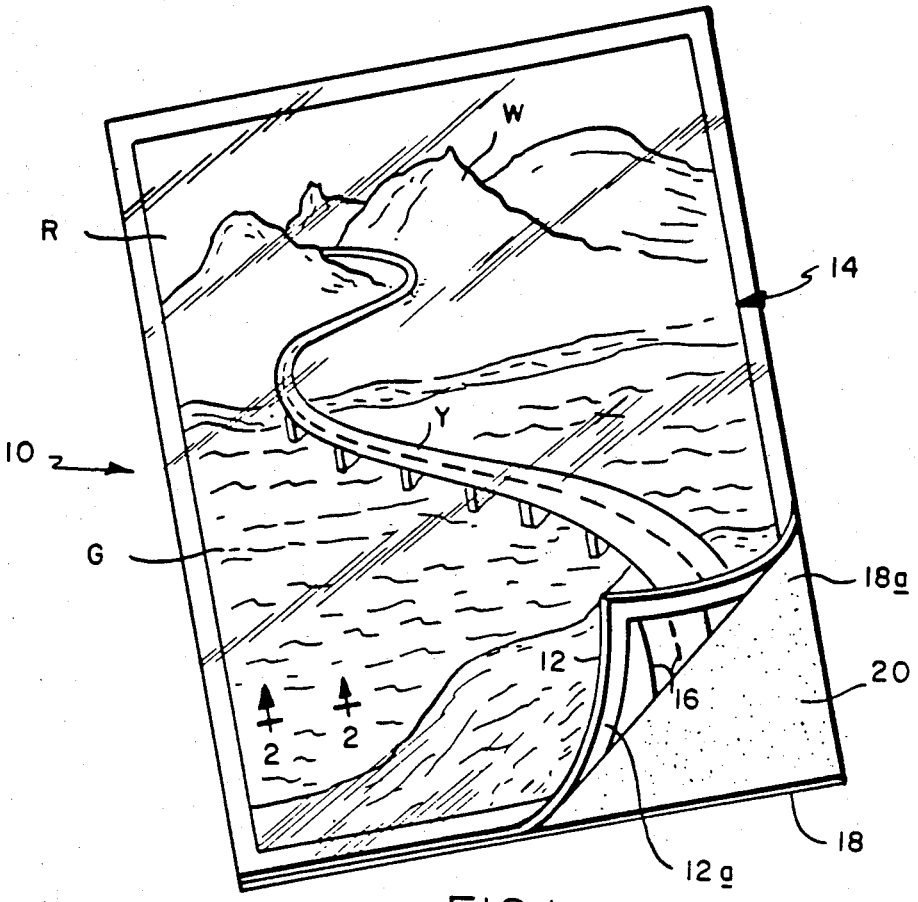
FIG. 1 is an isometric view showing a color-printed record made in accordance with this invention.

FIG. 1 of the drawing shows a record 10 printed in color which incorporates the principles of this invention. We have illustrated the record 10 as a printed copy of an original photograph or picture having grren areas G, reddish areas R, white areas W, and yellow areas Y. However, it should be understood that it could just as well be a page of printed text or of a combination of text and pictures and have any selected areal extent. As seen in FIG. 1, the record 10 is a layered structure comprising an upper sheet 12 of a flexible, transparent material such as the plastic film material marketed under the trademark Mylar. A sheet 12 made of this material has a smooth finish and is impervious to moisute and absorbs ultraviolet light. A color image shown generally at 14 is printed onto one surface of the sheet 12. In accordance with the invention, the image is produced by applying ink 16 to the surface of sheet 12 opposite the surface being viewed by the observer, i.e., to the sheet undersurface 12*a*. This means that if image 14 is a copy of an original document or picutre, the ink image applied to sheet surface 12*a* is a reversal of the original document or picture.

The ink 16 applied to surface 12*a* can be any high quality, water or oil base ink. Most desirably, however, it is a hot-melt or plastic ink. Although it is possible to use a conventional hot-melt ink such as the one disclosed in U.S. Pat. No. 4,390,369, the preferred ink is the one having high optical density and clarity disclosed in the first two above-identified patent applications. Preferably, these inks are applied to surface 12*a* using the ink jet printer described in the last patent application identified above which prints following instructions from a digital controller. Since the image printed on sheet 12 is the reverse of the original image as noted above, the original image data is digitally reversed in a known manner before being applied to the printer.

Figure 2:
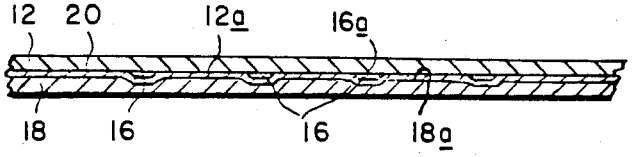
FIG. 2 is a sectional view on a larger scale taken along line 2—2 of FIG. 1.
Figure 3:
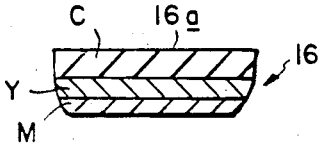
FIG. 3 is a similar view on a much larger scale showing part of the FIG. 1 record in greater detail.

As described in detail in the above application, the special hot-melt phase-change subtractive color inks are jetted onto sheet surface 12*a* as distinct droplets that form colored dots or spots 16 as shown in FIG. 2. These colored dots 16 are arranged in a matrix format so that together they define the image 14. Furthermore, as disclosed in those applications, each droplet 16 is composed of one or more ink layers corresponding to the primary subtractive colors cyan (C), magenta (M), yellows (Y), and sometimes also black (B). By subtractive color mixing, these layered dots 16 combine to produce all of the colors R, G, W, and Y in the image 14 on record 10 as viewed from above in FIG. 1. The color possibilities for a given image embrace the entire color spectrum from red to black.

As each first layer coloted ink droplet reaches the sheet surface 12*a*, the contacting surface 16*a* of the droplet flattens to conform to the finished sheet surface 12*a*, so that the interface or boundary beteween the droplet and the sheet is generally flat or planar. Thus as shown in FIG. 2, the leftmost printed spot 16 in that figure is composed of a cyan layer C which is applied to the sheet surface as a heated liquid droplet. However, as soon as that droplet strikes the relatively cool sheet surface 12*a*, it flattens, sets and adheres strongly to the plastic surface so that the resulting print sits right on that surface as a relatively thick ink layer having a high optical density. The ink layers Y and M comprising that same dot are applied as successive drops which adhere to the previous layer and, more or less, flatten in the same fashion. Since each ink layer comprising each dot 16 sets immediately upon reaching the medium surface or a previously applied ink layer, each layer is well defined and there is no turbid mixing of the different ink colors in each drop 16. Rather, there is a definite planar boundary between the adjacent differently colored ink layers and between the first ink layer C and the sheet surface 12*a*, with all of these boundries or interfaces being generally parallel to one another as shown.

After the ink spots 16 are jetted onto sheet surface 12*a* to form the colored image 14 thereon, the sheet is turned over and its surface 12*a* is affixed to the surface 18*a* of a coextensive opaque backing sheet 18. Ordinarily, sheet 18 is a sheet of plain white uncoated paper so that it provides a white background for the subtractive color spots 16. The two sheets may be held together by suitable means such as a transparent adhesive coating 20 preapplied to the surface 18*a* of sheet 18. Alternatively, if the record 10 is to be framed, the electrostatic attraction of the two sheets may suffice for this purpose. In any event, when the image 14 is viewed through the transparent sheet 12, i.e., from above in FIG. 1, the observer perceives all of the colors in image 14 a by true subtractive color mixing process.

Of course, if there are special lighting conditions or if special colored inks are used to produce the spots 16, sheet 18 may have a different color in order to produce a full range of colors in the image 14. If, for example, the record 10 is being viewed in pink light, it may be desirable to use a pink backing sheet.

I have found that when such hot-melt inks 16 are printed or painted onto the transparent sheet 12 and that sheet is placed printed-side-down against the white backing sheet 18, the color image 14 produced on this composite structure is unusually bright and vivid and comparable in quality to the image on color copies printed using conventional offset processes and it even approaches the quality of photographic prints.

While the reasons for the startling improvement in color brightness are not completely understood, it is believed that the applying of each ink spot 16 to the sheet 12 causes the surface of the spot that adheres to the sheet surface 12*a* (which is the surface that faces the viewer when he looks at the image 14 on record 10) to be very smooth and flat and in very intimate contact with the sheet. Consequently, light diffusion and reflections at the print-surface boundary are minimized. Also, since the ink layers C, Y, and M have high optical densities and are well defined with minimal intermixing of inks between layers, each layer subtracts the correct portion of the color spectrum from the white light reflected from backing sheet 18 and there is minimal diffusion of light at the boundaries between layers. Resultantly, the colored inks 16 observed through the transparent sheet 12 appear especially vivid and they combine to create an image 14 that is very bright and true in color. The resolution of the image 14 depends upon the number of ink spots 16 per inch therein. This may be selected to suit the particular record application by appropriately controlling the ink jet printer used to make the record.

It will be appreciated also that the ink print 16 that forms the image is captured and encapsulated between the two sheets 12 and 18 so that it is completely protected from the adverse effects of moisture, oxidation, abrasion and even heat to some extent. Furthermore, since the transperent sheet 12 is usually made of a plastic that absorbs ultraviolet light, the image 14 does not even fade after prolonged exposure to sunlight or the radiation from the fluorescent lights normally found in the workplace. Accordingly, the image 14 on the record 10 should not deteriorate appreciably over time. Still, with all of these advantages, the record 10 can be made at very low cost. Therefore the present invention lends itself particularly to the production in volume of high quality graphics and pictures from computer generated data. Indeed, it should now be possible, using my technique to print out with a matrix printer, color graphics and pictures of photographic quality at a cost which is an order of magnitude less than the cost of producing comparable pictures using standard photographic or offset processes.

It will thus be seen that the objects set forth above, among those made apparent from the preceeding description, are efficiently attained, and since certain changes may be made in the above product and in the method for making the product, it is intended that all matter contained in the above description or shown in the accompanying drawing shall be interpreted as illustrative and not in a limiting sense.

It is also to be understood that the following claims are intended to cover all of the generic and specific features of the invention herein described.

What is claimed as new and desired to be secured by Letters Patent of the United States is:

1. A method of making a printed record in color comprising the steps of:

A. dimensioning a flexible, transparent sheet according to the dimensions of the desired record;

B. applying an ink in one or more more layers and in one or more colors as a liquid onto selected portions of said sheet so that the ink forms on said portions solid, well defined, optically clear adherent printing composed of one or more different color ink layers; and, C. positioning a flexible opaque backing sheet flush against the inked surface of said transparent sheet so as to reflect ambient light back through said one or more ink layers and said transparent sheet whereby to produce by a subtractive color process visible through the transparent sheet a color record that is characterized by high color density and brightness.

2. The method defined in claim 1 and including the additional step of adhering together the contacting surfaces of said sheets.

3. The method defined in claim 1 or 2 and including the additional steps of:

A. selecting an original image from which to make the printed record;

B. acquiring and storing a digital representation of said original image;

C. reversing said stored digital representation; and

D. applying said reversed digital representation to control the application of ink to said transparent sheet.

4. The method as defined in claim 1 when said ink is applied to said sheet by jetting the ink onto small areas of said selected sheet portions as successive liquid drops, each of which solidifies prior to the impingement of a succeeding drop at the same area of the sheet.

5. A color printed record comprising:

A. a sheet of flexible transparent material;

B. one or more superimposed thin layers of an optically clear, subtractive color ink adhered to selected surface portions of the transparent sheet, the ink in the layer closest to the sheet having a well-defined planar suface in intimate contact with the surface of said sheet;

C. a flexible opaque backing sheet that is reflective to ambient light; and

D. means for affixing said backing sheet flush to the inked surface of said transparent sheet so that the backing sheet reflects ambient light back through each ink layer and the transparent sheet whereby to produce a color image visable through the transparent sheet that is characterized by high color density and brightness.

* * * * *